United States Patent [19]

Morris

[11] Patent Number: 4,711,036

[45] Date of Patent: Dec. 8, 1987

[54] PENDULUM OPERATED OSCILLATING BOW SIGHT

[76] Inventor: Eddy Morris, Box 17, Level Acres, Eufaula, Ala. 36027

[21] Appl. No.: 821,892

[22] Filed: Jan. 23, 1986

[51] Int. Cl.[4] ..... F41G 1/46

[52] U.S. Cl. ..... 33/265

[58] Field of Search ..... 33/265; 124/87

[56] References Cited

U.S. PATENT DOCUMENTS

| | | | |
|---|---|---|---|
| 2,925,656 | 2/1960 | Genovese | 33/265 |
| 3,013,336 | 12/1961 | Pennington | 33/265 |
| 4,400,887 | 8/1983 | Mason | 33/265 |
| 4,580,349 | 4/1986 | Webb | 33/265 |

*Primary Examiner*—Harry N. Haroian

*Attorney, Agent, or Firm*—Newton, Hopkins & Ormsby

[57] ABSTRACT

A pendulum operated, oscillating bow sight is disclosed for use in aiming a bow and arrow. A sighting pin is moved through the range of sighting distances by a lever having a pendulum counterweight on one arm and a sighting pin operatively connected to the other arm. As the elevation of the bow is changed, the pendulum remains in the same relative position, the lever acting to move the sighting pin for an accurate sighting of the target. Only the sighting pin projects into the sight window of the bow, thereby assuring the archer full visibility from the pin to the target, the operative mechanism being mounted on the side of the bow opposite the sight window.

11 Claims, 13 Drawing Figures

PENDULUM OPERATED OSCILLATING BOW SIGHT

BACKGROUND OF THE INVENTION

Using a bow and arrows for hunting or target shooting requires a high degree of accuracy. Among the many variables which must be taken into account are distance, height, arrow weight, windage, bow strength, and the skill of the archer. Thus, many shooting aids and sights have been devised to help achieve proper aim. Sighting aids normally fall into one of three general types: cross-hair sights, multiple pin sights and electronic devices which may indicate the relative elevation, the correct draw for the bow, and other factors.

Most sighting aids attach to the bow in the vicinity of the hand grip such that the sighting elements, for example, the cross-hairs, are disposed in the sight window of the bow. By sighting through such a device, a relatively accurate shot can be obtained, providing, of course, that all of the variables have been taken into consideration. Some sighting devices have been designed specifically for hunting and some are designed specifically for target shooting, two very different sports, while others are adaptable for either sport. The difficulty involved in accurate shooting can be realized by the many different types of sights available, no one sight being acceptable to a majority of archers.

SUMMARY OF THE INVENTION

It is, therefore, one of the principal objects of the present invention to provide a pendulum operated oscillating bow sight that can be affixed to a plurality of different types of bows and used by a plurality of archers for accurate shooting in the sport of archery using a pendulum operated, oscillating sighting means, and which provides essentially full visibility for the archer.

Another object of the present invention is to provide a bow sight that eliminates the need to judge the distance of the shot, enabling one to shoot down from a tree stand toward the base of the tree, for example, or outwardly from the archer's position to the maximum distance the arrow will carry and points therebetween, all with substantial accuracy.

A further object of the present invention is to provide a bow sight that is lockable in any of its adjusted positions for shot repetition, as in target shooting, or when the archer desires not to use the sight, and which is lightweight for ease of carrying.

These and other objects are attained by the present invention which relates to a pendulum operated oscillating bow sight, adapted for connection to an archery bow, and having a plate member for connection to the bow, a lever means mounted on the plate member for rotation relative thereto, and a weighted means and arm means secured to the lever means, being disposed approximately ninety degrees apart. The arm may have has a carriage means mounted thereon with a sighting pin which projects into the line of sight of the archer or the sighting pin may be mounted on the lever means, both assemblies being self-adjusting as the inclination of the bow is changed. This arrangement disposes only the sighting pin in the sight window of the bow, the mechanism being mounted on the opposite side from the sight window.

The present sight may be connected to any of a wide variety of archery bows and provides an accurate sighting device for hunting or target shooting. The device adjusts for sighting close or distant shots and is unobtrusive during use or transport.

Various other objects and advantages of the present oscillating bow sight will become apparent from the below description, with reference to the accompanying drawings.

BRIEF DESCRIPTION OF THE DRAWINGS

FIG. 8(*a*) is a perspective view of the alternate embodiment shown in FIG. 8, here being detached from the bow;

FIG. 12*a, b,* and *c* are diagrammatic views of three possible sighting positions with the bow sight embodiment shown in FIGS. 10 and 11.

DETAILED DESCRIPTION OF THE PREFERRED EMBODIMENT

Figure 1:
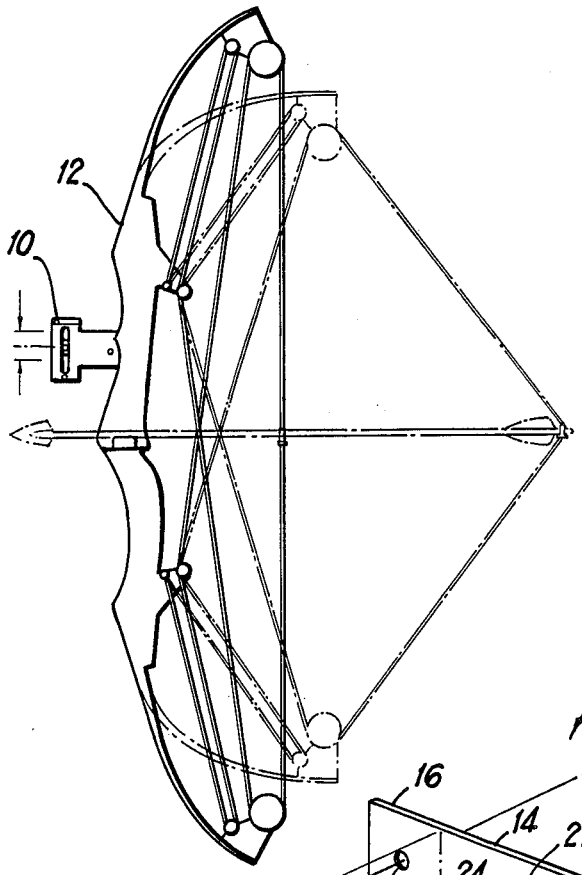
FIG. 1 is a side elevational view of an archery bow having the present pendulum operated bow sight mounted thereon.
Figure 2:
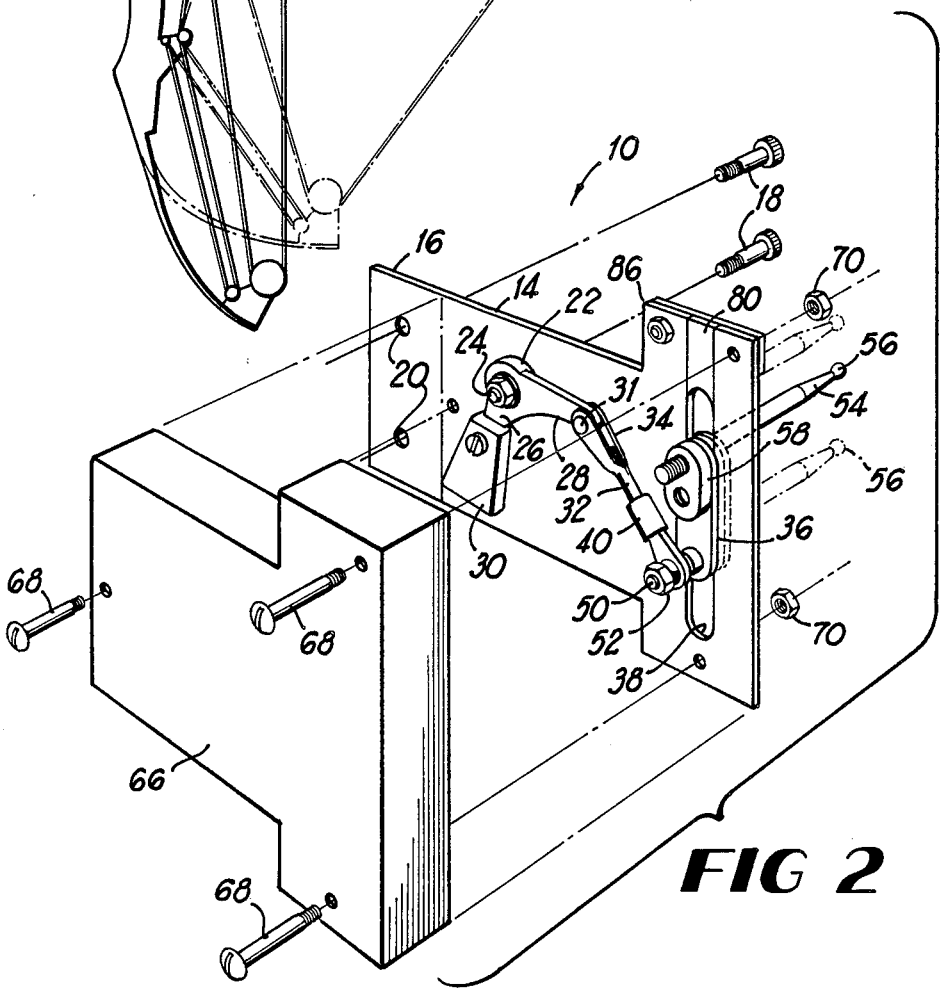
FIG. 2 is an exploded, perspective view of the present invention, showing the interior mechanisim.

Referring now more specifically to the drawings, and to FIG. 1 in particular, numeral 10 designates generally the present pendulum operated, oscillating bow sight, shown here in mounted position on bow 12. The present device is easily mounted on an archery bow using any suitable securing means, is lightweight, being composed of a lightweight metal or plastic, and presents no hindrance to carrying or shooting the bow.

The bow sight 10 has a base member or plate 14, adapted for connection to the bow through the lateral extension projecting from the side of the plate opposite the sighting means, and indicated at 16. Suitable securing means, such as screws 18, are disposed through holes 20 in the lateral extension and through corresponding holes (not shown) in the side of the bow opposite the sight window.

The present device is operated by a pendulum means which oscillates as the elevation of the bow is changed. An arcuate lever means, such as a bell crank 22, is mounted for rotation on plate 14 on a suitable axis means such as screw or pin 24. The bell crank has radial extensions projecting therefrom, a lower extension 26, projecting substantially downwardly from the axis, and an upper extension 28, projecting at approximately a right angle from extension 26, and adapted for carrying a sighting means, as described below. Secured to the end of extension 26 is a weighted means such as counterweight 30. Journalled in the end of the other extension 28 by a pin or rivet 31 is an arm member or linkage means, such as turnbuckle 32, having a fork or yoke 34 at one end for pivotal connection with arm extension 28. The opposite end of the turn buckle is connected to a carriage means 36, which has grooved sides and is slidable in a track 38 provided in plate 14. Arm 32 can be adjusted for length, being threadably mounted in the yoke portion 34 through a collar 40, and is secured to the carriage means in any convenient manner, such as with screw 50 and nut 52.

Figure 3:
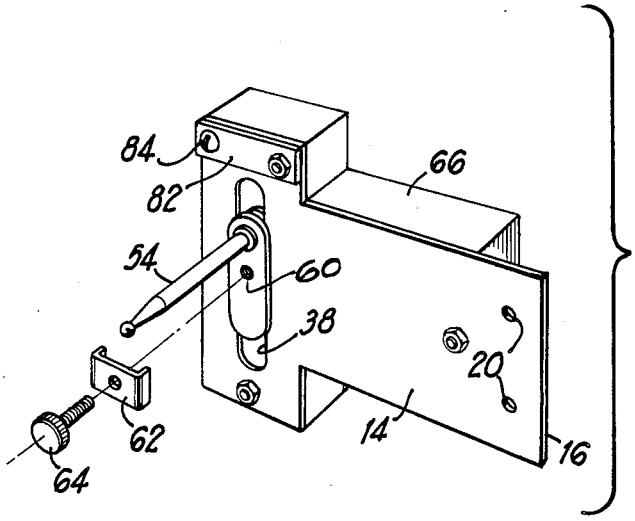
FIG. 3 is a perspective view of the present device in assembled form and showing the locking mechanism exploded therefrom.

Secured to the lever means through the carriage means and projecting radially therefrom is a sighting means, such as pin 54. The pin is secured to the carriage for movement therewith as the carriage slides in track 38. The outer end of pin 54 may have a sighting bead 56 formed at the tip thereof and the connected end is threaded or provided with other means to permit the lengthwise adjustment of the pin for windage adjustments. The pin is mounted in the carriage 36 with the threaded end in an oval block member 58. Block 58 has a second hole means 60 below the sight pin for mounting a locking clip 62 with screw 64 or other fastening means, as shown in FIG. 3. The fastening means may be used when the archer wishes the sight pin to remain stationary, for example, when repeating a shot, or for non-use of the sight when desired. To assure full visibility, only the sighting pin is visible through the sight window, the bow sight mechanism being mounted on the opposite side of the bow.

A cover member or housing 66 is secured to plate 14 with suitable fastening means, such as screws 68 and nuts 70, to cover and protect the pendulum mechanism. The track 38 in plate 14 has an abutment means such as a cap 80, shown in FIGS. 4 and 6, for limiting the travel of the carriage and for allowing the removal or installation of the carriage. A suitable means, such as bar 82 is mounted over the cap to secure it in place, the bar being secured in a convenient manner, as with one of the screws 68 and nuts 70 and another screw 84 and nut 86.

Figure 4:
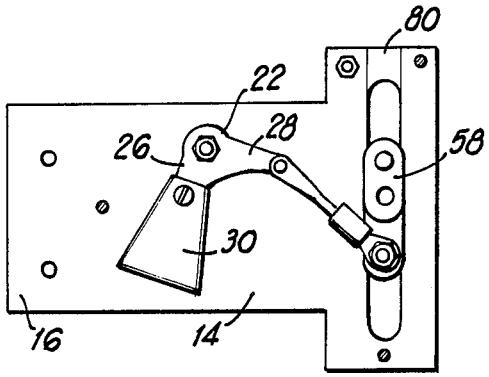
FIG. 4 is a side elevational view of the bow sight with the cover removed, detailing the interior mechanism and the positioning thereof when the bow is approximately perpendicular to the ground.
Figure 5:
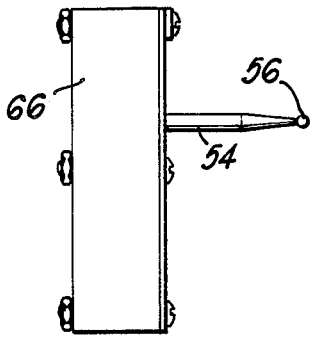
FIG. 5 is an end elevational view of the bow sight showing the position of the sighting member when the bow is in the position shown in FIG. 4.
Figure 6:
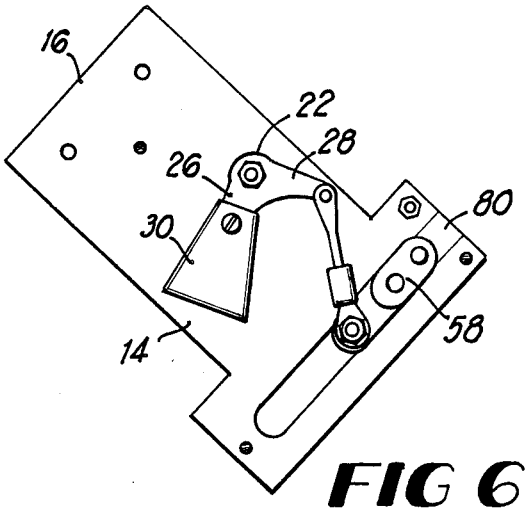
FIG. 6 is a side elevational view similar to that shown in FIG. 4, showing the positioning of the interior mechanism when the bow is tilted downwardly.
Figure 7:
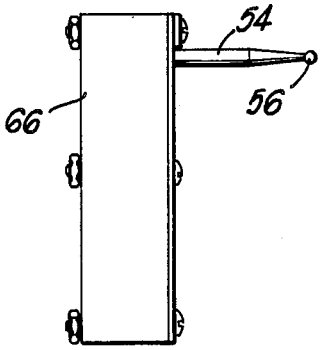
FIG. 7 is an end elevational view of the bow sight showing the positioning of the sighting member when the bow is held in the position shown in FIG. 6.

The use and operation of the present bow sight may be explained with reference to FIGS. 4 through 7. The counterweight 30 and the carriage assembly, are balanced against one another to an extent. The counterweight, however, being heavier tries to maintain a substantially plumb position with respect to the inclination of the present bow sight. FIG. 5 indicates the positioning of the sight pin 54 when the bow sight is oriented as shown in FIG. 4. As the bow and bow sight are inclined for a shot in a generally vertical direction the counterweight maintains a substantially constant orientation, thereby causing the sighting pin to move up or down in the direction opposite from the inclination of the bow. Thus, as shown in FIGS. 6 and 7, as the bow is inclined downwardly, the carriage and the sighting pin travel upwardly, thereby providing for an accurate sighting of the target.

Figure 8A:
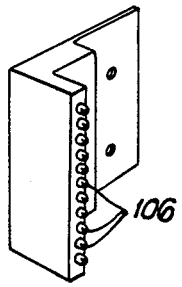
FIG. 8 is an alternate embodiment of the present invention, with the pendulum mechanism activating light means for sighting.
Figure 8:
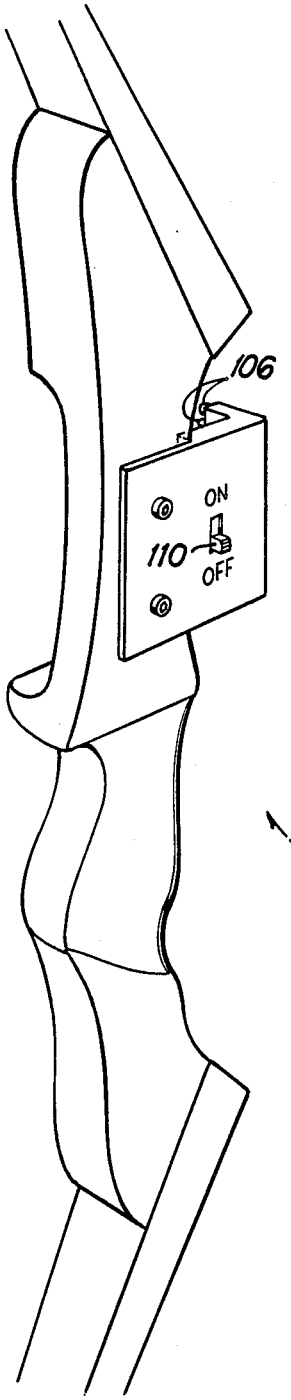
Figure 9:
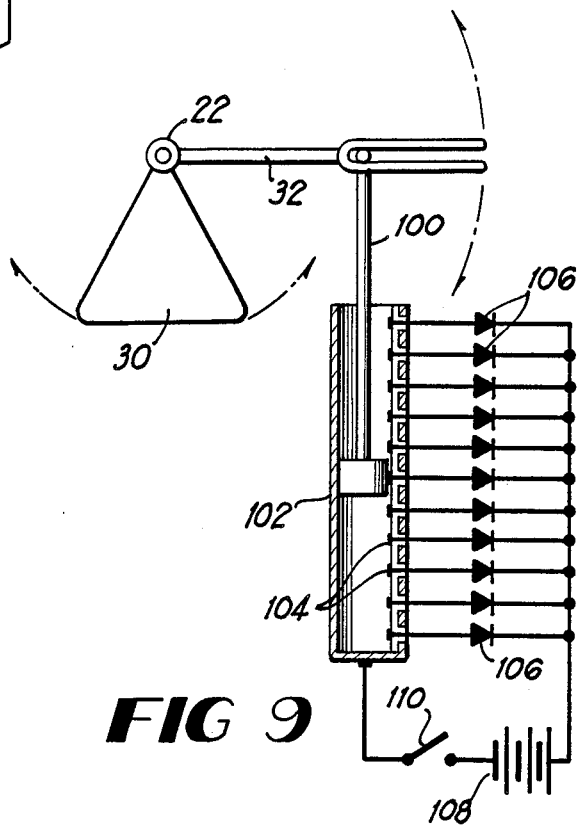
FIG. 9 is a schematic diagram of the mechanism employed in the embodiment of FIG. 8.

An alternate embodiment of the present invention is shown in FIGS. 8, 8(*a*) and 9. The same principles are employed and the mechanism is schematically shown in FIG. 9. The bell crank 22 has counterweight 30 and turnbuckle 32 secured thereto as described above. The carriage means in this embodiment is an electrical contact arm 100 which is operatively associated with the sighting means and is moved through a sending device such as a linear potentiometer 102. The contact arm makes electrical contact with circuit means 104 which are connected to a series of light-emitting diodes 106 or LED indicators, these only being visible to the archer through the sight window. The sight may be adapted for a means for supplying power, such as a battery 108 and an activating switch 110. Locking means (not shown) may also be provided as in the first-described embodiment. As the arm 100 contacts the individual circuits, the respective individual diodes are activated, thereby providing the archer with an accurate sighting means. In addition, the principles employed herein, the pendulum and the associated linkage means, may be extended to other forms, in which the pendulum means, for example, a weighted ball disposed in an arcuate track, acts to move the lever means and the sighting means attached thereto.

Figures 10, 11, 12:
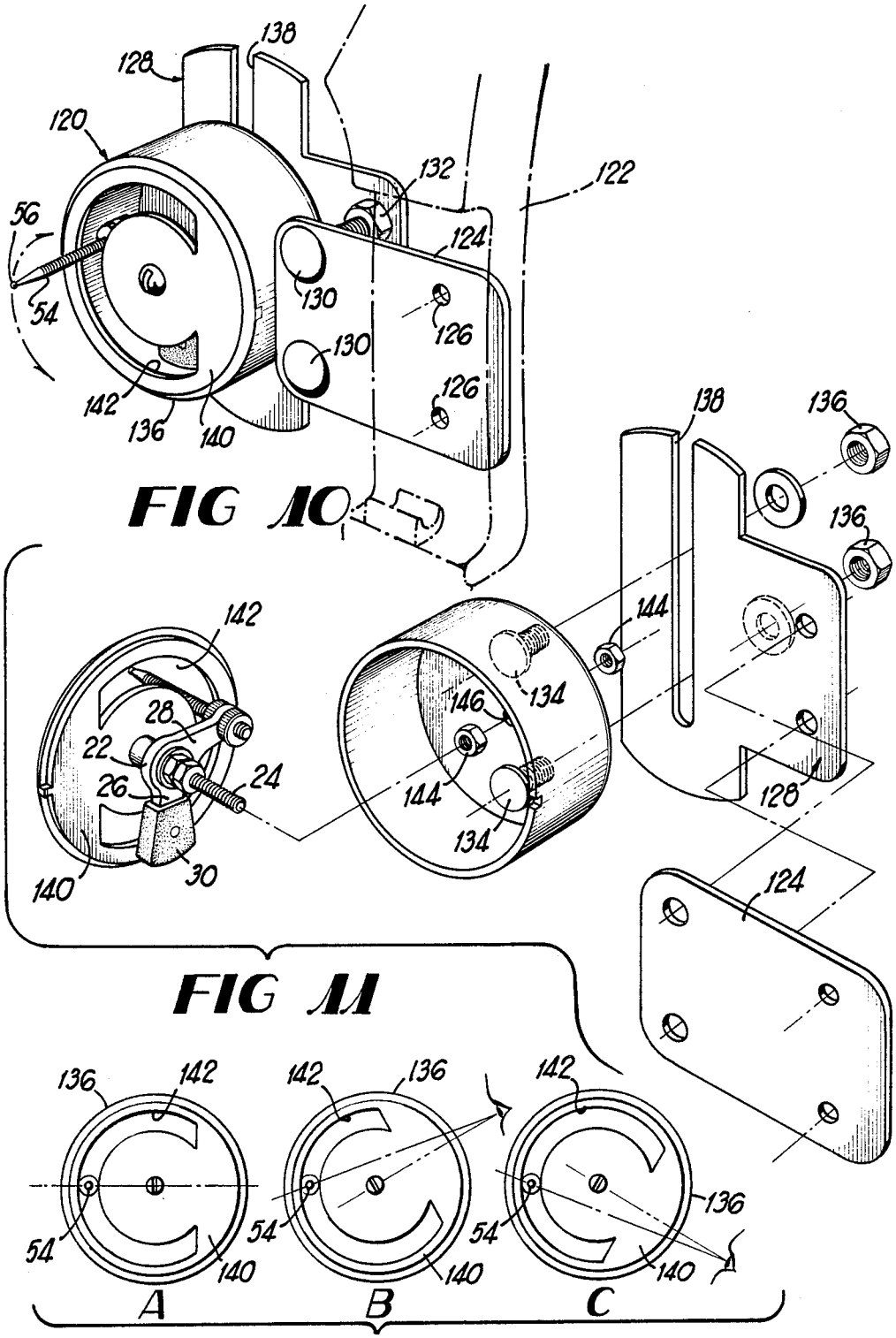
FIG. 10 is a perspective view of an alternate embodiment of the present bow sight, shown here assembled and ready for mounting on a bow.
FIG. 11 is an exploded, perspective view of the bow sight shown in the preceding figure.

A further alternate embodiment of the present invention is shown in FIGS. 10 through 12. In FIG. 10, the bow sight 120 is shown ready for mounting on bow 122. The sight is attached to the bow on the side opposite the sight window with suitable securing means, (not shown), such as screws or bolts, which are inserted through plate member 124 by way of apertures 126. Plate 124 is mounted on a base. member 128 with a suitable securing means such as bolts 130 and nuts 132. A nut 132 is disposed on each side of the base member for radially adjusting the mounted position of the device with respect to the bow.

Secured to the base member in any convenient manner, as with bolts 134 and nuts 136 is a housing 136. The bolts which secure the housing are mounted in a track 138, formed in the base member, for axially adjusting the mounted position of the device with respect to the bow. The sight can thus be mounted near the sight window of the bow and adjusted both radially and axially to dispose only the sighting means or pin in the line of sight of the archer.

The present embodiment is also operated by a pendulum means. The lever means, or bell crank 22 is mounted for rotation on a suitable axis, such as screw 24, which is in turn mounted on a cover means or plate 140. The lower extension 26 holds the counterweight 30 while the upper extension 28 carries the sighting means. The sighting means or pin 54 is secured in upper extension 28 and projects radially through a slot means or track 142, formed in plate 140. The arcuate track 142 provides a wide vertical range within which to aim the bow, from point-blank shots toward the base of a tree from a stand, to shots at the upper distance limit of the particular bow and arrow. As above, pin 54 is axially adjustable to compensate for windage or other factors.

The cover means or plate 140 is secured to the housing 136 by nuts 144. An aperture 146 is provided in the back wall of the housing and a nut is mounted on screw 24 on each side of the back wall.

FIGS. 12*a*, *b* and *c* depict schematically three different sighting positions, illustrating the line of sight of the archer and the position of pin 54 in the present embodiment of the device, relative to the archer. The use and operation of this embodiment are essentially the same as with the previous embodiments, i.e., as the bow is elevated for a distant shot, the pendulum, maintaining its substantially plumb position, causes the pin to move downwardly in the arcuate track. The opposite reaction is created as the elevation of the bow is lowered, thereby providing an accurate means of sighting the target through the pin.

All of the embodiments of the present device enable the archer to set up a wide range of shots from point-blank shots, toward the base of a tree from a tree stand, to an extended shot at the outer limit of carry for the particular bow and arrow. The invention responds almost immediately to changes in inclination and provides substantially full visibility for the archer, thus providing a high degree of accuracy in shooting. The present invention may also be constructed in a left-hand version for left-handed archers, the right hand embodiment being shown here to simplify the understanding of the device. The opposite versions would simply be a mirror image of the versions shown here.

While an embodiment of a pendulum operated, oscillating bow sight and modifications thereof have been shown and described in detail herein, various other changes and modifications may be made without departing from the scope of the invention.

I claim:

1. An oscillating bow sight for use in aiming a bow and arrow comprising a plate member for connection to the bow, said plate member having means defining an elongated track therein, a lower means mounted on said plate member for rotation relative thereto and having a weighted means and an arm means secured thereto and disposed approximately ninety degrees from one another, said arm means having a carriage means secured thereto and received in said elongated track, and sighting means projecting radially from said carriage means and disposed in the line of sight of an archer using the bow.

2. An oscillating bow sight as defined in claim 1 in which said carriage means has securing means for selectively preventing movement thereof.

3. An oscillating bow sight as defined in claim 2 in which said plate member has an axis means projecting radially therefrom for rotatably receiving said lever means.

4. An oscillting bow sight as defined in claim 1 in which said sighting means includes a pin having a threaded end for connection to said carriage means, with the opposite end of said pin having a sighting bead disposed thereon.

5. An oscillating bow sight as defined in claim 4 in which said plate member has an axis means projecting radially therefrom for rotatably receiving said lever means.

6. An oscillating bow sight as defined in claim 3 in which said weighted means includes a counterweight disposed below the point of connection of said axis means and said lever means, for gravitationally seeking the lowest position as the elevation of the bow sight is changed during the use thereof, and for moving said pin in a direction opposite from the inclination of the bow.

7. An oscillating bow sight for use in aiming a bow and arrow comprising a base member for mounting to the bow and having generally vertical track means formed therein, a lever means rotatably mounted and connected with said base member and having a lower extension with a counterweight secured thereto for maintaining said lower extension in a generally vertical, plumb position, and an upper extension with a sighting means operatively connected therewith and disposed in the line of sight of an archer using the bow, said bow sight having a housing means around said lever means with fastening means extending therefrom and disposed in said track means for axially adjusting the position of said housing means with respect to the bow.

8. An oscillating bow sight as defined in claim 7 in which said housing means includes a cover plate having an arcuate track formed therein and said sighting means projects radially from said upper extension through said arcuate track.

9. An oscillating bow sight for use in aiming a bow and arrow comprising a base member for mounting the sight to the bow, said base member having a track formed therein, a lever means rotatably mounted on said base member and having a lower extension with a counterweight secured thereto for maintaining said lower extension in a generally vertical, plumb position and an upper extension with a sighting means operatively connected therewith and disposed in the line of sight of an archer using the bow, said upper extension including an arm means pivotally secured at one end to said upper extension and a carriage means disposed on said track and secured to the opposite end of said arm means for receiving said sighting means.

10. An oscillating bow sight as defined in claim 9 in which said base member has an axis means projecting radially therefrom for receiving said lever means.

11. An oscillating bow sight as defined in claim 10 in which said sighting means includes a pin having a threaded end for connection to said carriage means and for axial adjustment, and having a sighting bead disposed on the end opposite said threaded end.

* * * * *